US008677525B1

(12) United States Patent
Martin et al.

(10) Patent No.: US 8,677,525 B1
(45) Date of Patent: Mar. 25, 2014

(54) PATIENT LIFTING DEVICE

(71) Applicant: Willis E. Martin, Rocky Mount, NC (US)

(72) Inventors: Willis E. Martin, Rocky Mount, NC (US); Rodney Barr, Cary, NC (US)

(73) Assignee: Martin Manufacturing Co., LLC, Rocky Mount, NC (US)

( * ) Notice: Subject to any disclaimer, the term of this patent is extended or adjusted under 35 U.S.C. 154(b) by 0 days.

(21) Appl. No.: 13/863,463

(22) Filed: Apr. 16, 2013

Related U.S. Application Data

(62) Division of application No. 12/963,837, filed on Dec. 9, 2010, now Pat. No. 8,464,371.

(60) Provisional application No. 61/285,045, filed on Dec. 9, 2009.

(51) Int. Cl.
*A61G 7/00* (2006.01)
*A61G 7/14* (2006.01)

(52) U.S. Cl.
USPC ..... 5/86.1; 5/81.1 R; 5/83.1; 5/620; 5/510; 5/201; 5/202; 5/175; 5/181

(58) Field of Classification Search
USPC ..... 5/86.1, 81.1 R, 83.1, 201, 202, 175, 181
See application file for complete search history.

(56) References Cited

U.S. PATENT DOCUMENTS

| | | | | | |
|---|---|---|---|---|---|
| 975,007 | A * | 11/1910 | Werner | 5/202 |
| 1,348,572 | A * | 8/1920 | McGhee | 5/3 |
| 2,644,959 | A * | 7/1953 | Blanke et al. | 5/185 |
| 2,644,960 | A * | 7/1953 | Blanke et al. | 5/185 |
| 3,042,936 | A * | 7/1962 | Patterson | 5/83.1 |
| 3,099,020 | A * | 7/1963 | Garfield et al. | 5/87.1 |
| 3,646,623 | A * | 3/1972 | Harris et al. | 5/181 |
| 4,019,211 | A * | 4/1977 | Spitz | 5/181 |
| 7,721,366 | B2 * | 5/2010 | Lee et al. | 5/201 |
| 2007/0028381 | A1 * | 2/2007 | Palay et al. | 5/81.1 R |
| 2007/0124858 | A1 * | 6/2007 | Ahlman | 5/81.1 R |
| 2007/0234475 | A1 * | 10/2007 | Sharps | 5/81.1 R |
| 2009/0013462 | A1 * | 1/2009 | Mahdjoubi | 5/81.1 R |

* cited by examiner

*Primary Examiner* — Robert G Santos
*Assistant Examiner* — Ifeolu Adeboyejo
(74) *Attorney, Agent, or Firm* — Coats and Bennett, PLLC

(57) ABSTRACT

A patient lifting apparatus is provided and which is operative to lift an injured person or patient from a lower area to an elevated position where the patient or injured person can be easily and safely transferred to a stretcher or other support device. The patient lifting apparatus includes a pair of side sections that are interconnectable. Each side section includes a lifting device and a lifting bar which is movable up and down. In a connected mode, the two side sections are connected together and the lifting bars include attachments for attaching to a patient support. Once attached to the patient support, the lifting bars via the lifting device are operative to lift the patient support upwardly generally between the two side sections where the patient can be transferred to a stretcher or other structure.

7 Claims, 2 Drawing Sheets

PATIENT LIFTING DEVICE

CROSS-REFERENCE TO RELATED APPLICATIONS

The present application is a Divisional of U.S. application Ser. No. 12/963,837 filed Dec. 9, 2010, which is a non-provisional of U.S. Provisional Application Ser. No. 61/285,045 filed on Dec. 9, 2009, which are herein incorporated by reference in entirety.

FIELD OF THE INVENTION

The present invention relates to patient lifting devices, and more particularly to patient lifting devices that are capable of lifting a patient or injured person from a lower position to an upper position where the patient or injured person can be easily transferred to a stretcher or other support device.

BACKGROUND OF THE INVENTION

Correctly and safely lifting patients and injured persons is a difficult task. It is difficult from at least two viewpoints. First, it is important to lift the patient or injured person without further injuring the person or aggravating an existing injury. Secondly, and what may be surprising to many, it is important to lift the person or patient without injuring the nurses, EMT/EMS personnel or other healthcare workers engaged in handling patients and injured persons. The number of injuries suffered by healthcare personnel in lifting patients and injured persons is huge.

One particular area of concern is that of lifting an injured person that has fallen or been injured in an accident such as an automobile accident. It is critical that the initial handling of the injured person be carried out in such a way that no further injuries occur to the injured person due to lifting and handling. This is particularly challenging at accident sites when there are serious injuries to a person. A great deal of care and time is exercised in initially moving the injured person from the ground, for example, onto a stretcher. This is particularly difficult and challenging where the injured person is obese or even heavy.

Therefore, there has been and continues to be a need for a patient lifting device that because of its nature and design will generally prevent injured persons from being further injured when being moved from an initial position onto a stretcher. Further, there is a need for a patient lifting device that includes a power lift for lifting the patient and positioning the patient or injured person for transfer onto a stretcher or other support device and which does not require actual lifting by medical personnel.

SUMMARY OF THE INVENTION

The present invention entails a patient lifting device that is operative to lift an injured person or patient from a lower area to an elevated position where the patient or injured person can be easily and safely transferred to a stretcher or other support device.

In one embodiment, the present invention entails a frame structure that can be easily split into half sections (side sections) where each section includes a lift assembly. There is also provided a patient support structure that is connectable to the lift assembly associated with each of the half sections. The device is designed to lift the support and a patient or injured person thereon to a selected height, after which a stretcher or other support structure can be positioned below the support.

The lift assembly is operative to lower the support and patient onto the stretcher after which the stretcher can be easily removed from the framed structure.

Other objects and advantages of the present invention will become apparent and obvious from a study of the following description and the accompanying drawings which are merely illustrative of such invention.

DESCRIPTION OF EXEMPLARY EMBODIMENT

Figure 1:
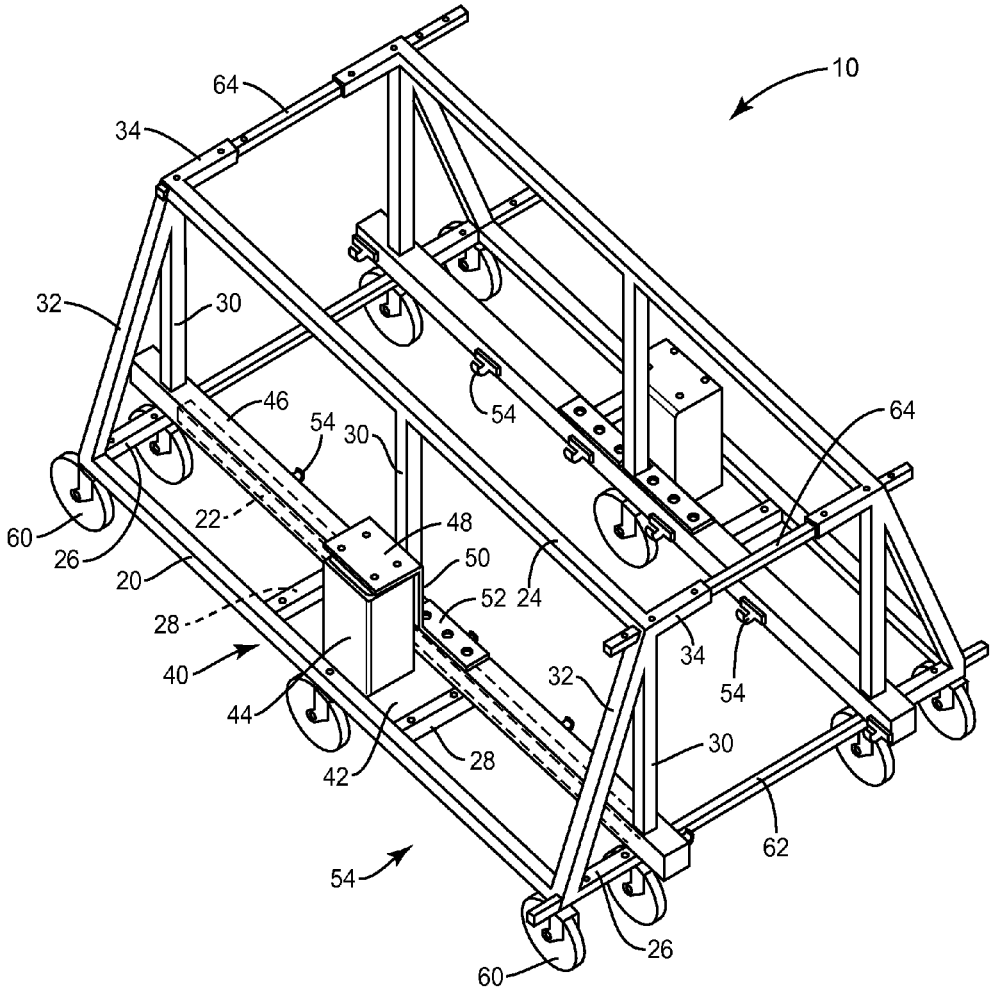
FIG. 1 is a perspective view of the frame structure of the patient lifting device.

The present invention relates to a patient lifting apparatus indicated generally by the numeral 10 in the drawings. The patient lifting apparatus 10 is designed to lift an injured person from a lower surface to a selected height after which another support structure, such as a stretcher, can be conveniently positioned below the injured person. The patient lifting apparatus is operative to transfer the injured person, or in some cases a patient, to the underlying support structure. As more fully discussed below, the patient lifting apparatus 10 is provided with a flexible and pliable support, such as a fabric structure. The patient or injured person is meticulously placed on the support. Thereafter, a frame structure is oriented adjacent the patient or injured person and the support underlying the patient is connected to a lift assembly that forms a part of the frame structure. Actuating the lift assembly causes the patient or injured person to be raised a selected height. After which a stretcher or other type of support structure can be inserted below the patient and the patient or injured person can be lowered onto the stretcher or support structure. Thereafter, the frame structure carrying the lift assembly can be removed from around the patient, or the patient can simply be moved along with the stretcher from the frame structure.

With further reference to the drawings, the patient lifting apparatus 10 includes a frame structure 12 and a patient support 14. Support 14 will be described in more detail subsequently herein, but briefly, the support in the embodiment disclosed is a flexible and pliable fabric support structure that can be easily placed underneath a patient or injured person. Frame structure 12, as shown in the drawings, comprises two half sections or side sections that are easily separable and connectable. As discussed below, once the patient or injured person is appropriately disposed on the support 14, the side sections that make up the frame structure 12 are positioned about the patient or injured person and connected together. Thereafter, support 14 is connected to the lift assembly associated with the half sections and the lift assembly is actuated causing the support 14 and the person lying thereon to be elevated.

The following discussion addresses the frame structure 12. As noted above, the frame structure is made up of two like side sections that are attachable and detachable. See FIG. 1. The following discussion will simply describe one side section, but it will be understood that the description of the side section applies equally to both sections of the frame structure 12.

Each side section of the frame structure 12 includes a pair of spaced apart lower longitudinal runners 20 and 22. In addition, there is provided an upper longitudinal runner 24. A series of cross members extends between the lower longitudinal runners 20 and 22. More particularly, about opposite ends of each half section is a lower cross member 26 that connects the lower longitudinal runners 20 and 22. Each cross member 26 is generally hollow, and as will be discussed below, this enables the cross members to receive a connecting bar that is effective to connect the side sections of the frame structure 12 together. In addition, there is provided a pair of intermediate cross members 28. As will be appreciated from subsequent portions of the disclosure, these intermediate cross members 28 serve to reinforce the basic frame structure, but also serve to support the lift assembly.

Each side section includes a series of vertical guide posts 30 that extend upwardly between the lower longitudinal runners 20 and 22 and the upper longitudinal runner 24. More particularly, there are three vertical posts 30 that extend upwardly from the inner longitudinal runner 22. Vertical posts 30 are longitudinally spaced apart and connected between a respective inner longitudinal runner 22 and the upper longitudinal runner 24. In addition, each side section includes two inclined vertical posts 32. Vertical posts 32 are disposed on opposite ends of the side section. Each inclined vertical post 32 extends from the outer longitudinal runner 20 upwardly to the upper longitudinal runner 24. Thus, it is appreciated that about opposite ends of the side section, the posts 30 and 32 form a generally inverted V-shape.

Secured about opposite ends of the side section is a connecting sleeve 34. Each connecting sleeve 34 is hollow, and as depicted in the drawings, extends generally laterally with respect to the side section. As will be discussed later, these connecting sleeves 34 receive connecting bars that function to connect the two side sections together.

Each side section includes a lift assembly for connecting to the support 14 and lifting the support and the patient or injured person thereon. The lift assembly associated with each side section is indicated generally by the numeral 40. Lift assembly 40 includes a base plate 42. Note that base plate 42 is connected between the intermediate cross members 28 that extend between the lower longitudinal runners 20 and 22. Secured to the base plate 42 and extending upwardly therefrom is a column lift or lifting device 44. Details of the column lift are not shown herein because such is not per se material to the present invention, and further, column lifts are known and commercially used today. In the case of this embodiment, the column lift 44 is of a vertical orientation and is powered electrically by AC or DC current. In particularly, the column lift 44 may be powered by a 24 VDC battery, or 110 VAC. Column lift 44 includes a piston that raises and lowers relative to the housing. Lift assembly 40 further includes a lifting bar 46. Lifting bar 46 is an elongated bar that extends along the inner side of each side section. As shown in the drawings, the lifting bar 46 includes a series of openings, and wherein the three inner vertical posts 30 project through the openings in the lifting bar 46. Thus, as the lifting bar 46 is moved up and down, the three vertical posts 30 function to align and maintain the lifting bar 46 such that it moves up and down in a vertical plane. Although not shown, disposed within the openings in the lifting bar 46 are bushings that facilitate the vertical movement of the lifting bar about the vertical post 30.

There is provided a connector between the column lift 44 and the lifting bar 46. Various types of connectors can be utilized. In this case, the connector for each lift assembly 40 includes a plate 48 that is secured to the piston of the column lift 44. A leg 50 depends downwardly from the plate 48 and connects to a connecting flange 52. Connecting flange 52 lies flush against the upper surface of the lifting bar 46 and is secured thereto by bolts, screws, or other suitable fastening means.

Secured along the inner side of the lifting bar 46 is a series of spaced apart hooks 54. Hooks 54 are designed to connect to the support 14. Each side section includes a series of wheels 60 connected to the lower portion thereof. In the case of the embodiment illustrated herein, each side section includes six wheels, two wheels at opposite ends and two wheels intermediately disposed generally underneath the column lift 44. These wheels 60 enable the side sections to be moved from location to location. In one embodiment, the wheels 60 are castor wheels that facilitate maneuverability.

As alluded to before, each side section is connectable to a like side section. This is achieved by a series of connector rods. In the embodiment illustrated herein, there are four connector rods connecting the half sections. These connecting rods include two lower connector rods 62 and two upper connector rods 64. Note that the lower connector rods 62 extend through the cross members 26 disposed at opposite ends of each side section. As discussed above, the cross members 26 are hollow and this enables the connector bars 62 to be extended through the cross members. The cross members 26, as well as the lower connector rods 62 include openings for receiving locking pins. Likewise, the upper connector rods 64 project through the connector sleeves 34 that project inwardly from opposite ends of the side sections. Again, the upper connector rods 64 and the connector sleeves 34 include openings for receiving locking pins.

Turning to the support structure 14, the support structure can be constructed of various materials. For example, the support structure may comprise a pliable and flexible structure, a semi-pliable and flexible structure, or even a rigid structure.

Figure 2:
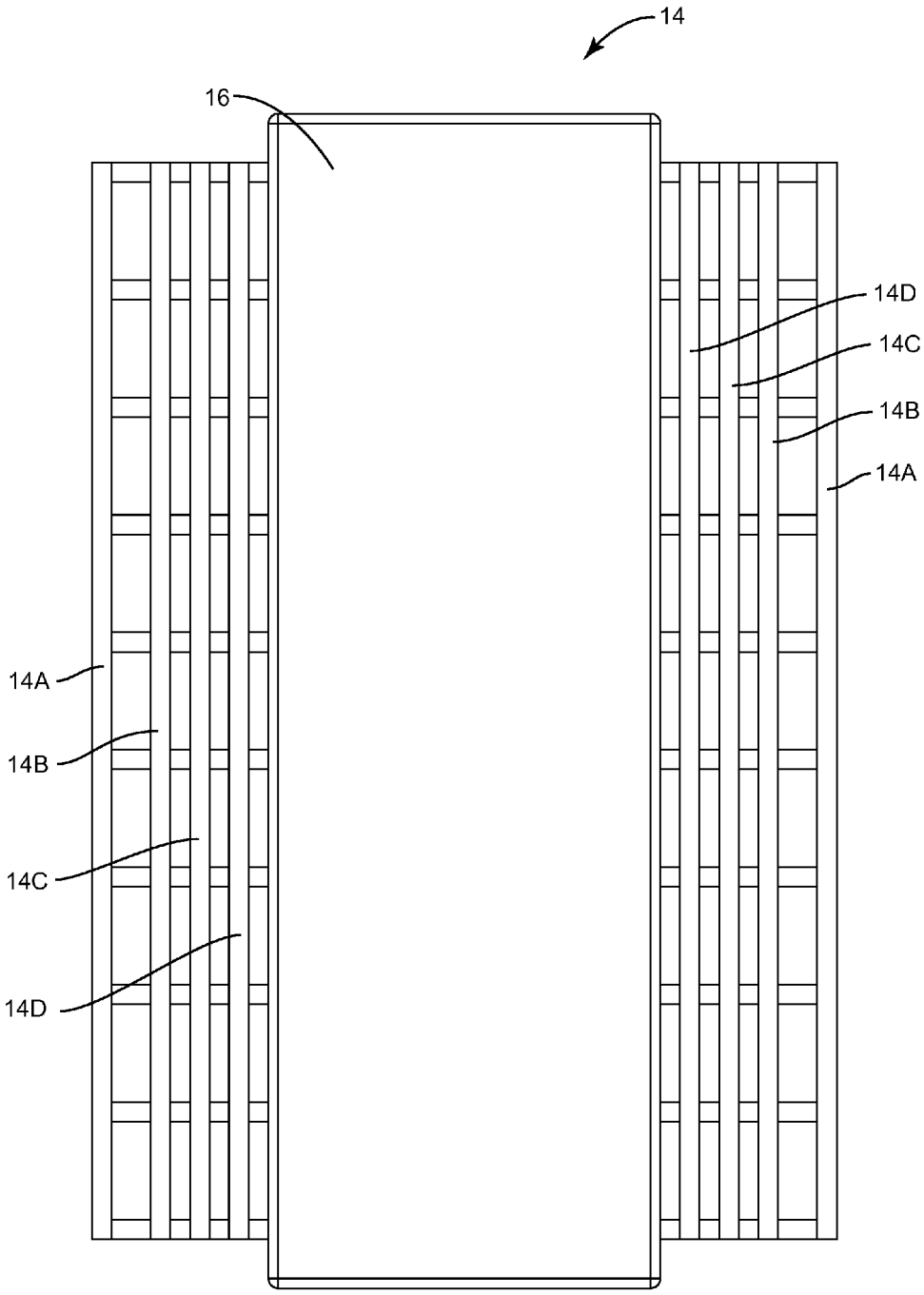
FIG. 2 is a plan view of the support that is adapted to be attached to the patient lifting device.

In the embodiment illustrated herein, the support structure comprises a pliable and flexible structure. As shown in FIG. 2, the support structure includes a central support 16. Central support can comprise various materials. In the embodiment illustrated in FIG. 2, the central support 16 is elongated and comprises a foam pad that is upholstered.

Disposed along each side of the support adjacent the central support 16 is a series of longitudinal connectors 14A, 14B, 14C, and 14D. Each connector is adapted to be connected to the hooks 54 that form a part of the lift assembly 40. It may be desirable to color code the various connectors 14A, 14B, 14C, and 14D on each side of the central support 16. This will ensure that the same connector is used on each side of the central support 16. The reason that a series of connectors in this embodiment are provided on each side of the central support 16 is that the size of patients and injured persons may vary and this provision enables the central support 16 to be appropriately connected to the lift assembly 40 at an appropriate location relative to the patient or injured person. Again, it should be emphasized that the support 14 can vary and can be a totally fabric structure or a combination of various materials such as fabric, foam, upholstered foam, etc.

In use, the patient or injured person is placed on the support 14. Assume there is an injured person laying on the ground or on a floor or paved surface. The support 14 is laid adjacent the injured person. Skilled personnel, such as EMT/EMS personnel, meticulously position the patient on the support 14. Once the injured person is properly positioned on the support 14, then the side sections are placed on opposite sides of the support 14, and with a clam shell approach, the two side sections are connected together by the connecting rods 62 and 64. Once the side sections are connected together, it is appreciated that the injured person laying on the support 14 is disposed generally between the lifting members 46 of the frame structure 12. Now, the connectors (14A, 14B, 14C or 14D) associated with the support 14 can be connected to the hooks 54 of the lift assembly 40. Again, the connectors 14B, 14C, and 14D of the support 14 are color coded such that the same connector on each side of the main body 14 of the support is connected to the hooks 54. Once the support 14 is connected to the hooks 54, the lift assembly 40 is actuated. This causes the column lift or lifting device 44 to raise, and this in turn raises the lifting bars 46 on each side of the frame structure. As the lifting bars 46 move upwardly, the support 14 and the patient supported on the support will likewise be moved upwardly. Once the injured person and the support 14 has reached a selected height, the lift assembly 40 is deactivated, leaving the injured person and the support 14 suspended between the half sections. At this point, at least one of the lower connector rods 62 is removed from the frame 12. This enables the interior of the frame structure 12 to be accessed by a stretcher or other support device. The stretcher, for example, is lowered to a lower position. That is, the stretcher is lowered to where the upper surface thereof is at an elevation below the suspended support 14. Then, the stretcher is inserted into the frame structure to a point where the stretcher underlies the support 14 and the injured person laying on the support. Now, the lift assembly is lowered, resulting in the support 14 being lowered onto the stretcher. The connectors associated with the support 14 are then disconnected from the hooks 54. At this point the loaded stretcher can be retracted from the frame structure 12 or the frame structure 12 can be moved away from the stretcher.

From the foregoing specification and discussion, it is appreciated that the present invention presents a safe and reliable means for lifting an injured person or a patient from a lower position, such as a position on the ground or floor, and elevating that person to a height where a stretcher can be appropriately inserted underneath the patient or injured person. This provides a safe and reliable means for lifting a patient and disposing the patient on an appropriate support device.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method of lifting a patient on a patient support with a patient lifting apparatus, the method comprising:

splitting the patient lifting apparatus into two side sections where each side section is maneuverable independently of the other;

positioning the side sections on opposite sides of the patient support;

connecting the side sections together to form a unitary structure comprised of the two side sections and wherein when connected together the two side sections are disposed in spaced apart relationship and define an open space between the two side sections;

connecting a lifting bar associated with each side section to the patient support;

actuating a lifting device on each side section where the lifting device is operatively connected to the lifting bar and wherein the actuation of the lifting devices on each side section causes the lifting bar to raise and at the same time raise the patient support which is connected to the lifting bars; and wherein the patient lifting apparatus includes a plurality of connecting bars that extend transversely between the two side sections where the two side sections are connected together; wherein the method includes removing at least one connecting bar extending across one end of the patient lifting apparatus so as to form an unobstructed opening into an area between the two side sections; and inserting the patient support or other patient carrying device into the open area between the two side sections.

2. The method of claim 1 including connecting the two side sections together by extending a plurality of transversely extending bars between the two side sections and securing the transverse bars to the respective side sections.

3. The method of claim 1 wherein each side section includes a base frame supported by a plurality of wheels, wherein the lifting device is associated with the base frame, and the lifting bar is operatively connected to the lifting device and movable up and down in response to the actuation of the lifting device.

4. The method of claim 1 including lifting the lifting bar of each section and guiding the lifting bar with at least one generally vertical post that extends through an opening in the lifting bar.

5. The method of claim 4 wherein each side section includes a plurality of guide posts with each guide post extending generally vertically and wherein each guide post is extended through an opening in the lifting bar such that as the lifting bar moves up and down the series of guide posts generally guide the lifting bar up and down.

6. A method of lifting a patient on a patient support with a patient lifting apparatus, the method comprising:

splitting the patient lifting apparatus into two side sections where each side section is maneuverable independently of the other;

positioning the side sections on opposite sides of the patient support;

connecting the side sections together to form a unitary structure comprised of the two side sections and wherein when connected together the two side sections are disposed in spaced apart relationship and define an open space between the two side sections;

connecting a lifting bar associated with each side section to the patient support;

actuating a lifting device on each side section where the lifting device is operatively connected to the lifting bar and wherein the actuation of the lifting devices on each side section causes the lifting bar to raise and at the same time raise the patient support which is connected to the lifting bars; and lifting the lifting bar of each section and guiding the lifting bar with at least one generally vertical post that extends through an opening in the lifting bar.

7. The method of claim 6 wherein each side section includes a plurality of guide posts with each guide post extending generally vertically and wherein each guide post is extended through an opening in the lifting bar such that as the lifting bar moves up and down the series of guide posts generally guide the listing bar up and down.

* * * * *